United States Patent [19]

Aprea et al.

[11] 4,231,524

[45] Nov. 4, 1980

[54] LARGE FLOW NOZZLE

[75] Inventors: George F. Aprea, Dedham; Werner P. Pohle, Lynn, both of Mass.

[73] Assignee: Wm. Steinen Mfg. Co., Parsippany, N.J.

[21] Appl. No.: 56,870

[22] Filed: Jul. 12, 1979

[51] Int. Cl.[3] ..... B05B 1/34

[52] U.S. Cl. ..... 239/468

[58] Field of Search ..... 239/468, 490

[56] References Cited

U.S. PATENT DOCUMENTS

| | | | |
|---|---|---|---|
| 1,722,733 | 7/1929 | Coffey et al. | 239/468 |
| 2,904,263 | 9/1959 | Tate et al. | 239/468 X |
| 3,326,473 | 6/1967 | Wahlin | 239/468 |

*Primary Examiner*—Andres Kashnikow

*Attorney, Agent, or Firm*—Ostrolenk, Faber, Gerb & Soffen

[57] ABSTRACT

A nozzle having intersecting perpendicular inlet and outlet axes is constructed with a cylindrical whirl chamber into which liquid is introduced from a transition passage. The latter is bounded by a flat surface of substantial width, with one end of the flat surface being tangent to the cylindrical surface defining the whirl chamber. In cross-section perpendicular to the flat surface and to the direction of liquid flow in the transition passage the latter is bounded by a straight flat section and a tapered down section connected to the ends of the flat section. This construction substantially reduces turbulence in the whirl chamber resulting in better controlled conical spray output for the nozzle.

13 Claims, 13 Drawing Figures

LARGE FLOW NOZZLE

This invention relates generally to spray nozzles of the type that produces a spray output formed as a cone centered on an axis which is at right angles to the inlet axis for the nozzle. More particularly, this invention relates to an improvement over the nozzle disclosed in U.S. Pat. No. 3,326,473 issued June 20, 1967 to F. W. Wahlin for a Spray Nozzle.

In spray nozzles for handling relatively large volumes of liquid, the configuration and quality of the output conical spray is, to a large extent, a function of turbulence within the whirl chamber of the nozzle. That is, as turbulence within the whirl chamber increases the cone angle decreases and output liquid flow becomes more erratic.

The prior art has recognized the foregoing problem and, as shown in the aforesaid U.S. Pat. No. 3,326,473, has sought to solve the problem by introducing liquid into the whirl chamber as such liquid flows tangent to the inner surface of the whirl chamber. However, the construction of the nozzle in the aforesaid U.S. Pat. No. 3,326,473 is such that tangency of liquid flowing into the whirl chamber is relatively small so that only limited improvement was obtained.

Pursuant to the instant invention, substantial improvement in spray quality is obtained by providing a nozzle construction in which a relatively great amount of liquid introduced into the whirl chamber flows tangent to the interior wall of the chamber. This is achieved by constructing the nozzle so that immediately upstream of the whirl chamber is a transition passage constructed with a flat surface of substantial width, with one end of the flat surface being tangent to the inner surface of the whirl chamber. In cross-section, the transition passage has a straight main section in the plane of the flat surface and extending parallel to the outlet axis of the nozzle. The remainder of the transition passage cross-section is symmetrical about a line which is a perpendicular bisector of the straight main section. The remainder of the transition passage tapers downward from the straight main section and, as will hereinafter be seen, may take a number of forms.

Accordingly, a primary object of the instant invention is to provide a novel construction for a spray nozzle.

Another object is to provide an improved spray nozzle having inlet and outlet orifices formed about perpendicular intersecting axes and constructed to produce a high quality spray.

Still another object is to provide a nozzle of this type having improved means for reducing turbulence in the whirl chamber of the nozzle.

A further object is to provide a nozzle of this type in which a substantial portion of the liquid entering the whirl chamber flows tangent to the inner surface of the whirl chamber.

These objects as well as other objects of this invention shall become readily apparent after reading the following description of the accompanying drawings in which:

FIG. 1 is a cross-section taken through line 1—1 of FIG. 2 looking in the direction of arrows 1—1.

FIG. 6 is an elevation looking toward the inlet or upstream end of a nozzle constructed in accordance with another embodiment of the instant invention.

Figures 5, 6A, 6B, 7, 8, 9:
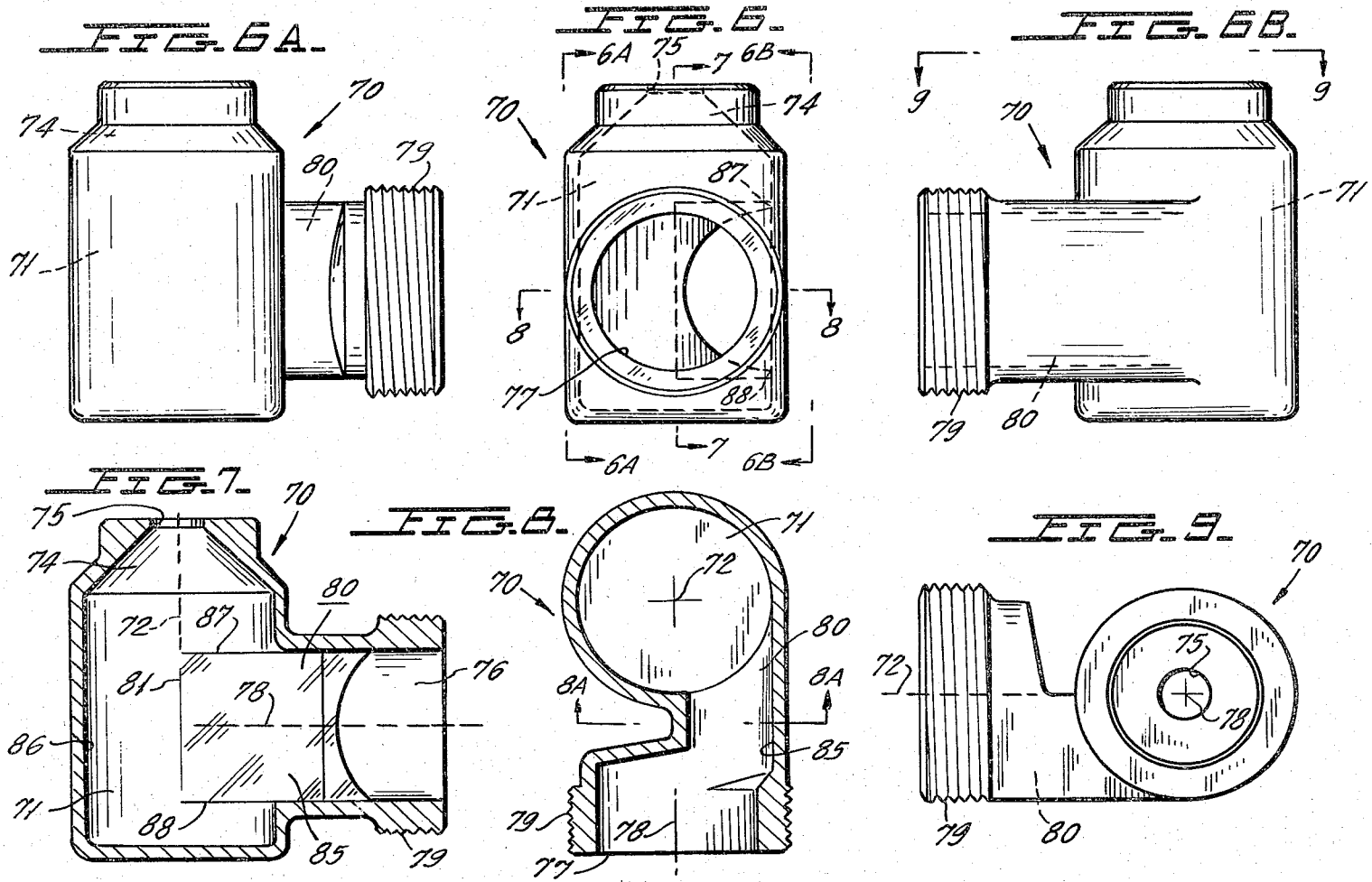
FIGS. 6A and 6B are side elevations looking in the direction of the respective arrows 6A—6A and 6B—6B of FIG. 6.

FIGS. 7 and 8 are cross-sections taken through the respective lines 7—7 and 8—8 of FIG. 6 looking in the directions of the respective arrows 7—7 and 8—8.

FIG. 9 is a front elevation looking in the direction of arrows 9—9 of FIG. 6B.

Figure 1:
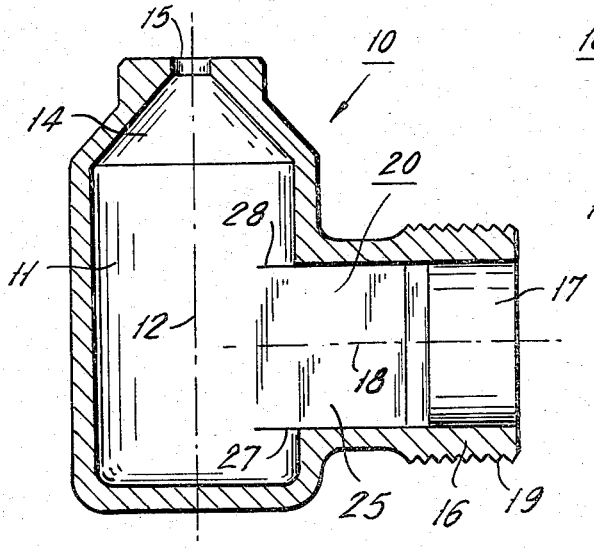
FIG. 1 is a longitudinal cross-section of a spray nozzle constructed in accordance with teachings of the instant invention. In particular
Figure 2:
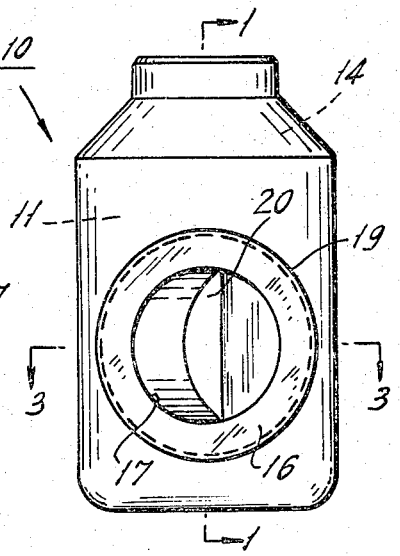
FIG. 2 is an elevation of the nozzle looking toward the inlet or upstream end thereof.
Figure 3:
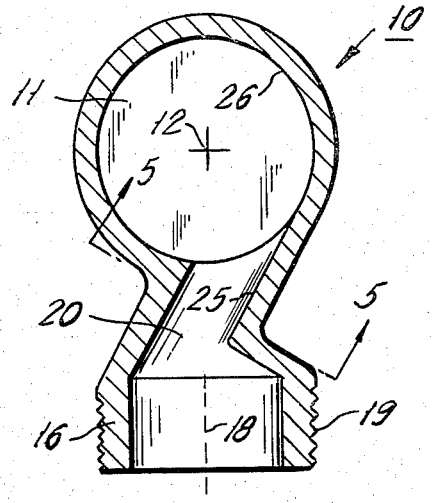
FIG. 3 is a cross-section taken through line 3—3 of FIG. 2 looking in the direction of arrows 3—3.

Now referring to the Figures. Nozzle 10 of FIGS. 1 through 3 is a single casting defining cylindrical whirl chamber 11 centered with respect to outlet axis 12. Conical outlet section 14 is at the downstream end of chamber 11. The narrow downstream end of section 14 is provided with discharge orifice 15 through which liquid exits from nozzle 10 in the form of a conical spray centered about outlet axis 12.

Nozzle 10 also includes cylindrical inlet section 16 having an inlet orifice 17 centered about inlet axis 18. The latter intersects outlet axis 12 and is perpendicular thereto. A liquid supply means, such as a hose (not shown) is attached to nozzle 10 at the threaded formation 19 on the outer surface of inlet section 16. The downstream end of inlet section 16 is connected to whirl chamber 11 by transition passage 20. In cross-section taken through a plane perpendicular to the direction of liquid flow through transition passage 20, the latter includes straight main section 21 and a remainder 22 which tapers downward from main section 21 and is symmetrical about line 23 which is a perpendicular bisector of main section 21. Straight main section 21 is located on flat surface 25 which extends the full length of transition passage 20 and is parallel to outlet axis 12. The downstream end of flat surface 25 is tangent to the cylindrical surface 26 which defines whirl chamber 11. While portions of whirl chamber 11 extend axially beyond both sides 27, 28 of flat surface 25, the width of the latter is rather extensive and tangency between surfaces 25, 26 is across the full width of surface 25. Because of this, a substantial portion of the liquid flowing through transition passage 20 is essentially tangent to surface 26 so that relatively little turbulence is created in whirl chamber 11. This lack of turbulence in chamber 11 results in a controlled wide angle conical discharge from orifice 15.

Figure 5:
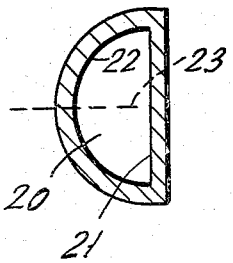
FIG. 5 is a cross-section of the transition passage taken through line 5—5 of FIG. 3 looking in the direction of arrows 5—5.

As seen in FIG. 5 the downwardly tapering portion 22 of transition passage 20 is semicircular and has a radius equal to one half the length of straight main section 21. FIGS. **5*a* and 5*b* illustrate alternate cross-sections for transition passages between inlet section 16 and whirl chamber 11. Transition passages 20*a* and 20*b* of the respective FIGS. 6 and 7 each include straight main section 21 and a downward tapering portion symmetrical about line 23**.

Figure 5A:
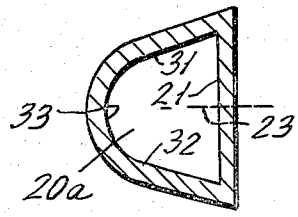
FIGS. 5A and 5B are views similar to FIG. 5 showing transition passages having cross-sections which differ from that shown in FIG. 5.
Figure 5B:
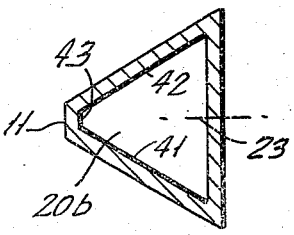

In FIG. 5A, converging straight sides 31, 32 extend from the ends of straight main section 21 and are connected by arcuate section 33. In FIG. 5B, converging straight sides 41, 42 extend from opposite ends of straight main section 21 and are connected by straight section 43 which is parallel to main section 21.

Figure 4:
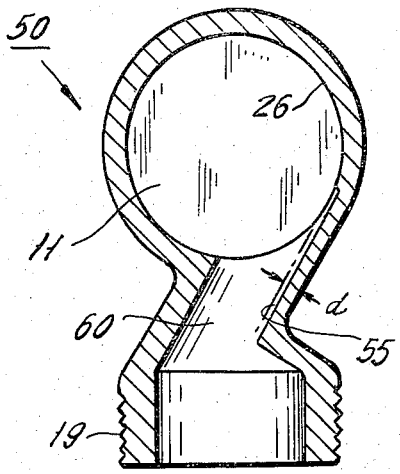
FIG. 4 is a view similar to FIG. 3 showing a slight modification.

While the instant invention has hereinbefore been described as one in which nozzle 10 includes a transition passage 20 wherein extensive flat surface 25 is tangent to boundary surface 26 of whirl chamber 11, as a practical matter acceptable results are obtainable even with slight variations from precise tangency. For example, nozzle 50 of FIG. 4 is identical to nozzle 10 of FIG. 3 except that flat surface 55 which partially defines transition passage 60 is essentially, though not precisely, tangent to wall 26 of whirl chamber 11. In a practical example whirl chamber 11 is $3\frac{1}{2}$ inches in diameter and the devition d from true tangency for flat surface 55 is 1/16 inch.

Now referring to FIGS. 6-9 which illustrate nozzle 70 constructed as a single casting defining cylindrical whirl chamber 71 centered with respect to outlet axis 72. Conical outlet section 74 is at the downstream end of chamber 71. The narrow downstream end of section 74 is provided with discharge orifice 75 through which liquid exits from nozzle 70 in the form of a conical spray centered about outlet axis 72.

Nozzle 70 also includes cylindrical inlet section 76 having an inlet orifice 77 centered about inlet axis 78. The latter intersects outlet axis 72 and is perpendicular thereto. A liquid supply means, such as a hose (not shown) is attached to nozzle 70 at the threaded formation 79 on the outer surface of inlet section 76. The downstream end of inlet section 76 is connected to whirl chamber 71 by transition passage 80. In cross-section taken through line 8A—8A of FIG. 8 looking in the direction of arrows 8A—8A, which line 8A—8A designates a plane perpendicular to the direction of liquid flow through transition passage 80, the latter is of the semi-circular form shown in FIG. 5, although it may have other cross-sections, such as those in FIGS. 5A and 5B. One side of transition passage 80 is flat surface 85 which extends along the direction of liquid flow through transition passage 80 and is parallel to inlet axis 72. The downstream end of flat surface 85 is tangent to the cylindrical surface 86 which defines whirl chamber 71. While portions of whirl chamber 71 extent axially beyond both sides 87, 88, indicated by line 81 (FIG. 7) is across the full width of surface 85. Because of this a substantial portion of the liquid flowing through transition passage 80 is essentially tangent to surface 86 so that relatively little turbulence is created in whirl chamber 71. This lack of turbulence in chamber 71 results in a controlled wide angle conical discharge from orifice 75.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A nozzle for producing a spray directed along an outlet axis, said nozzle including a conical outlet section having a discharge orifice at its downstream end and being centered about said outlet axis, a cylindrical whirl chamber disposed at the upstream end of said outlet section and centered about said outlet axis, an inlet section disposed upstream of said chamber and having an inlet orifice centered about an inlet axis perpendicular to said outlet axis, a transition passage disposed between said inlet orifice and said chamber, in cross-section transverse to direction of liquid flow therethrough said passage including a straight main section and a remainder including a downward tapering section extending from said main section, said main section being disposed on a flat surface of said passage, said flat surface and said main section being parallel to said outlet axis, said flat surface being essentially tangent to the inner surface of the wall defining said chamber.

2. A nozzle as set forth in claim 1 in which the downward tapering section is symmetrical with respect to a symmetry line drawn perpendicular to said straight main section and extending from a point midway between the ends thereof.

3. A nozzle as set forth in claim 2 in which the downward tapering section includes an arcuate portion.

4. A nozzle as set forth in claim 3 in which the arcuate portion is a semi-circle formed about a center located midway between the ends of said straight main section and having a radius equal to half the length of said straight main section.

5. A nozzle as set forth in claim 2 in which the downward tapering section includes straight sides extending from the ends of the straight main section.

6. A nozzle as set forth in claim 5 in which the straight sides at the ends thereof remote from said main section are joined by a straight section parallel to said main section.

7. A nozzle as set forth in claim 5 in which the straight sides at the ends thereof remote from said main section are joined by an arcuate section.

8. A nozzle as set forth in claim 2 in which all points of said remainder are no further from said symmetry line than the distance between each end of the main section and the symmetry line.

9. A nozzle as set forth in claim 2 in which the chamber in its measurement taken parallel to said outlet axis extends substantially beyond both sides of said flat surface.

10. A nozzle as set forth in claim 9 in which the downward tapering section includes an arcuate portion.

11. A nozzle as set forth in claim 1 in which the flat surface is in a plane angularly disposed with respect to said inlet axis.

12. A nozzle as set forth in claim 1 in which the flat surface is in a plane parallel to and laterally displaced from said inlet axis.

13. A nozzle as set forth in claim 1 in which the inlet and outlet axes intersect.

* * * * *